United States Patent [19]

Martin et al.

[11] Patent Number: 5,017,437

[45] Date of Patent: May 21, 1991

[54] PROCESS FOR MAKING CLAD ARTICLES AND ARTICLE MADE THEREBY

[75] Inventors: James W. Martin, Sinking Spring; Robert S. Brown, Leesport; E. Lance Buck, Reinholds; Gregory J. Del Corso, Sinking Spring, all of Pa.

[73] Assignee: Carpenter Technology Corporation, Reading, Pa.

[21] Appl. No.: 556,298

[22] Filed: Jul. 20, 1990

[51] Int. Cl.[5] ..... B22F 7/04

[52] U.S. Cl. ..... 428/558; 419/8; 419/49

[58] Field of Search ..... 428/558; 419/8, 99

[56] References Cited

U.S. PATENT DOCUMENTS 4,259,413 3/1981 Taglang et al. ..... 428/548
4,478,787 10/1984 Nadkarni et al. ..... 419/8
4,891,080 1/1990 Del Corso et al. ..... 148/326
4,895,609 1/1990 Baldi ..... 419/8

*Primary Examiner*—Stephen J. Lechert, Jr.
*Attorney, Agent, or Firm*—Dann, Dorfman, Herrell and Skillman

[57] ABSTRACT

A process for making a clad article of a densified metal powder core and a compatible metal cladding metallurgically bonded thereto results in a significantly reduced concentration of metal oxides in the core so as to prevent embrittlement of the core at and adjacent the core/cladding interface that results in rupture between the core and the cladding along the interface during working or forming. In carrying out the process, the temperature of the undensified metal powder and/or the temperature of the compatible metal container into which the metal powder is filled are closely controlled so as to avoid adsorption of moisture during the filling step.

14 Claims, 6 Drawing Sheets

PROCESS FOR MAKING CLAD ARTICLES AND ARTICLE MADE THEREBY

BACKGROUND OF THE INVENTION

This invention relates to a process for making clad articles of densified metal powder, and in particular to such a process for making a clad article having improved workability and formability as a result of the improved preparation technique.

U.S. Pat. No. 4,259,413 ('413 patent), R. J. Taglang and W. C. Ziolkowski, issued Mar. 31, 1981 and assigned to the assignee of the present application, discloses a clad article that includes a core of densified metal powder and a metal cladding that is compatible with the metal powder. The process disclosed for making the article includes compacting a metal container filled with prealloyed metal powder. The compacted, powder-filled container is then hot and/or cold worked to form a shaped, clad article.

The '413 patent stresses the need to prepare the interior of the container properly before the powder is added and points out that cleaning with a solvent to remove foreign matters, though desirable, is not sufficient to remove adherent material or coatings including oxides. To remove such materials, particularly oxides, the '413 patent teaches the use of an organic solvent, followed by chemical, e.g., acid cleaning, or by mechanical cleaning, as by sanding or sand blasting. Any suitable technique for filling the containers with the metal powder can be used as long as the powder entering the container is free of adsorbed water. Vacuum filling in which the metal and the container interior are maintained at about 10 microns Hg is specified. Alternatively, metal powder that has been thoroughly dried, as by heating in a fluidized bed, may be filled in dry air or in a dry inert gas at atmospheric pressure. After air and water vapor have been eliminated, the container is sealed and then compacted.

U.S. Pat. No. 4,891,080 ('080 patent), G. J. Del Corso, J. W. Martin and D. L. Strobel, issued Jan. 2, 1990 and assigned to the assignee of the present application, relates to a workable, boron-containing, stainless steel article and the process for making such an article. The '080 patent discloses a powder metallurgy technique in which the metal powder is baked to remove moisture prior to being loaded into a similarly baked canister for compaction. The metal powder and the canister are baked at less than 400 F. to avoid oxidation. The '080 patent points out at column 5, lines 1–2 that the canister "must be clean and essentially free of oxides."

The teachings of the referenced patents have been used successfully to produce relatively small, clad articles containing less than about 400 pounds of metal powder in which the metal cladding is bonded to the densified metal powder core. The present invention stems from the discovery that, in such articles, metal oxides are inevitably present in a zone of the core adjacent the core/cladding interface. Here and throughout this disclosure, the terms "oxide" or "metal oxide" refer to any oxide of metals such as Mn, Cr, Ni, Fe, etc. When significantly larger intermediate articles such as billets or slabs, containing about 400 pounds or more of metal powder are made by such processes, the presence of a significantly larger concentration of such metal oxides in a zone of the core extending a limited distance from the interface toward the center of the core as compared to the remainder of the core material, results in significantly reduced local ductility compared to the remainder of the core material. Such reduced local ductility has adversely affected the workability of the clad article in such operations as forging or rolling, and would adversely affect its formability in such operations as drawing or bending.

SUMMARY OF THE INVENTION

It is, therefore, a principle object of the present invention to provide a process for making clad articles of densified metal powder that have significantly reduced concentrations of metal oxides at and adjacent the core/cladding interface with a resulting increase in local ductility so as to provide good workability and formability of such articles without regard to article size.

Another object of this invention is to provide a clad article having a core of densified metal powder and a metal cladding bonded thereto wherein a zone of the core adjacent the core/cladding interface has a significantly reduced concentration of metal oxides that results in increased local ductility so as to provide good workability and formability without regard to the size of the article.

A process in accordance with one aspect of the present invention reliably produces clad articles of densified metal powder so as to provide better workability and formability than articles prepared by the known techniques. This is most readily evident when the clad article contains about 400 pounds or more of metal powder. In carrying out the process of this invention, metal powder that is substantially free of oxides is maintained at a temperature or in a temperature range that is high enough to remove moisture from and prevent the adsorption of moisture by the metal powder and low enough to prevent oxidation of the metal powder in air. The hot metal powder is fed into a heated compatible metal container the interior surface of which is substantially free of oxide contamination and during filling is at a temperature that is high enough to remove moisture from and prevent the adsorption of moisture by the interior surface but low enough to prevent oxidation of the interior surface in air.

As the metal powder is fed into the container its temperature is controlled such that it is maintained high enough to prevent the adsorption of moisture. After the container is filled with the metal powder, it is sealed and then consolidated to densify the metal powder and metallurgically bond the container to the densified metal powder to form the metal cladding.

A shaped, clad article made by the process of the present invention includes a core of densified metal powder and a compatible metal cladding that is metallurgically bonded to the core. The core has a zone adjacent the core/cladding interface having a low average metal oxide volume fraction that is not significantly greater than the average oxide volume fraction of the remainder of the core so as to provide increased local ductility that is essentially equal to that of the remainder of the core. The increased ductility of the core zone adjacent the cladding that is characteristic of the clad article of this invention compared to articles made by the known processes, results in better workability and formability of the article.

BRIEF DESCRIPTION OF THE DRAWINGS

Further objects and advantages of the present invention will be apparent from the following detailed description and the accompanying drawings wherein.

DETAILED DESCRIPTION

Figure 1A:
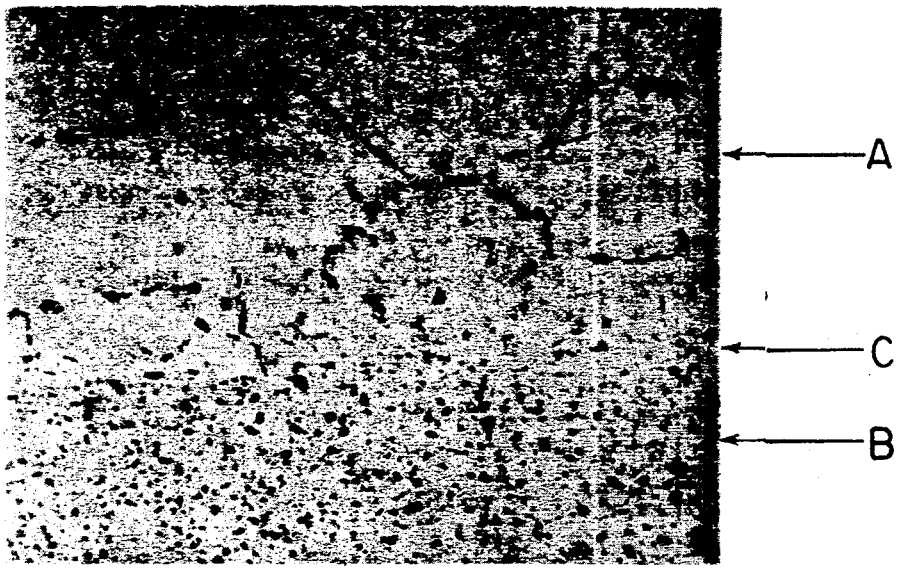
FIGS. 1A to 1C are photomicrographs at 400× showing transverse sections of the article of Example 1 herein, made by the process of the present invention, and including a portion of the cladding, "A", core, "B", and the interface between them, "C"

The preferred composition of the metal powder and the metal container and known preparation techniques therefor are disclosed in U.S. Pat. Nos. 4,259,413 and 4,891,080 which are incorporated herein by reference. For example, the broad and preferred ranges for a borated stainless steel powder hitherto used are set forth in Table I in weight percent.

TABLE I

| | Broad | Preferred |
|---|---|---|
| C | 0.10 max. | 0.05 max. |
| Mn | 2.00 max. | 1.00–2.00 |
| Si | 1.00 max. | 0.2–0.75 |
| P | 0.045 max. | 0.025 max. |
| S | 0.010 max. | 0.002 max. |
| Cr | 16.00–22.00 | 18.00–20.00 |
| Ni | 10.00–15.00 | 12.00–15.00 |
| Mo | 0–3.0 | 0.5 max. |
| B | 0.2–2.0 | 0.7–1.6 |
| N | 0.075 max. | 0.015 max. |
| Fe | Bal. | Bal. |

The preferred container material used with the foregoing composition is AISI Type 304L stainless steel, although other suitable materials can be used when desired. The process according to the present invention is applicable to clad articles formed of other metal powders as well, for example, borated aluminum powder or borated copper powder, in compatible, unborated metal containers. In general, the process is for use with difficult to work compositions that are clad with a compatible and relatively more ductile metal.

The process according to the present invention provides close control of the conditions under which metal powder is filled into the metal canister to significantly reduce the concentration of oxides in the core zone at and adjacent to the core-cladding interface of the clad article. In carrying out the process of the present invention the surfaces of the container components, particularly those that will form the interior of the assembled container, are cleaned, as by wiping, with a reagent grade of solvent, e.g., acetone. The reagent grade of solvent is preferred because its purity is such as to minimize if not eliminate any residue on the metal surfaces.

The container itself is assembled by welding in a manner designed to maintain the interior surface thereof essentially free of oxides. In the case of a round cross-section canister, the sidewall is preferably formed of a suitable grade of stainless steel pipe or tubing having a desired diameter and wall thickness. The sidewalls of a container having a rectangular cross-section can be assembled from two or more sidewall elements that are welded together. Gas metal arc (GMA) or gas tungsten arc (GTA) welding is preferred over other welding methods. Preferably, the sidewalls of the container, whether round or rectangular, are formed by a method that requires little or no welding, however. The container further includes end walls formed, in each instance, by a closure sealed in place by welding. One or more fill holes are provided, for example, in one of the end walls, to permit feeding the metal powder into the container.

The preferred assembly technique includes maintaining an inert fluid, preferably argon gas, in contact with the interior surface of the container during welding of the sidewall and end walls, at least in the area adjacent the welds, to inhibit the formation of oxides. The inert fluid is flowed through the interior of the container at a sufficient rate to prevent the inflow of air. If desired, one or more temporary walls can be used to cover the open end or ends during welding. Any opening between a temporary end wall and the sidewall is sealed temporarily, e.g., with tape, in order to prevent significant outflow of the inert fluid from the container's interior. The flow rate of the inert fluid is controlled to prevent a pressure build up inside the container assembly that would adversely affect the quality of the welds.

The assembled container is baked at a temperature in a range defined by a lower temperature that is high enough to remove moisture from the interior surface and an upper temperature that is low enough to prevent oxidation of the interior surface in air. For a container formed of AISI Type 304L stainless steel, baking in the range 140–400 F. and preferably about 200–250 F. has provided good results. No special atmosphere is needed for baking the metal container. Good results have been obtained when the container is baked in air.

A batch of the metal powder is maintained in a temperature range that is similarly defined by a lower temperature that is high enough to remove moisture from at least the surfaces of the powder particles and an upper temperature that is low enough to prevent oxidation of the metal powder in air. Metal powder formed of boron-containing stainless steel is preferably baked in the range of 170–400 F., and better yet at about 200–250 F. for a time sufficient to ensure that the center of the metal powder mass is maintained at the desired temperature. The metal powder can be heated in air, no special atmosphere is necessary. When desired, a protective atmosphere, e.g., vacuum or inert gas, can be used.

With the metal container and the metal powder at the respective, desired temperatures, the hot metal powder is loaded into the container through the fill hole. During the filling process it is important to control the temperature of the container and the metal powder so that each is maintained at a temperature within the temperature range sufficient to prevent the adsorption of water or other moisture by the metal powder or by the interior surface of the container. In the absence of a controlled temperature and humidity environment, the metal powder is loaded into the container preferably at a fill rate high enough to keep the heat loss of the powder and of the container as low as practical. Depending upon the duration of the filling step, it may be necessary to reheat the container and the metal powder so that they do not fall below the temperature necessary to prevent the adsorption of moisture. The temperature of the exterior surface of the container or the temperature of the metal powder can be monitored. The temperature of the container exterior surface is monitored by any suitable arrangement, preferably by means of a thermocouple in contact therewith. The temperature of the metal powder is monitored by any suitable arrangement, preferably by a thermocouple in intimate contact with the metal powder in the powder source vessel or in the container.

Should the temperature of the container exterior surface or the temperature of the metal powder reach or fall below the respective low temperature limits, then the filling operation is preferably stopped and the partially filled container and the metal powder remaining to be filled are reheated. When the container and the metal powder are at the desired temperature, the filling operation can be resumed.

Another technique for maintaining the container and the metal powder within their respective temperature ranges includes continuously heating the container, for example, by keeping it in an oven at the proper temperature, during the filling step. In a further embodiment of the process of this invention the container and metal powder temperatures can be maintained by enclosing the container and/or the powder source vessel with a suitable thermally insulating material to reduce the rate of heat loss during the filling step.

In carrying out the filling operation according to the present invention, the container can be filled in air, no special atmosphere being necessary. When desired, filling can be performed under a protective atmosphere. The container is filled with the metal powder, preferably to the maximum practicable fill density by using known techniques. When the filling operation is completed, the filled container can be reheated to about 200–250 F. to ensure proper powder and container temperature prior to sealing the fill hole in the end wall of the container. The fill hole is preferably sealed by welding a cover or cap over the fill hole.

When desired, the container can be tested for leaks prior to sealing. For example, such testing can be done by reducing the pressure inside the container to less than about 100 microns Hg. To perform such a leak test, under vacuum a tubulation is provided to facilitate connecting the container to a vacuum pump. In such case the container is sealed by pinching off the tubulation. After the container has been filled, tested for leaks, and sealed, it is consolidated in any suitable way. Good results are achieved by hot isostatic pressing to densify the metal powder and metallurgically bond the container to the densified metal powder so as to form an adherent cladding. The degree of consolidation is preferably such as to permit successful subsequent processing as by hot working or cold forming. The consolidated shape is then hot and/or cold worked to a desired shaped article including strip, sheet, plate, billet, bar, rod or wire. Preferred methods for consolidating and for hot and/or cold working the clad article of the present invention are set forth in U.S. Pat. No. 4,891,080. For example, the preferred method of consolidating the powder-filled container is hot isostatic pressing. The preferred methods of hot working the consolidated container include forging, hammering, rotary forging or flat rolling. Hot worked intermediate forms are preferably cold worked as by cold rolling or drawing. In some instances the cladding may be removed when hot and/or cold working, which is facilitated by the cladding being present, has been completed.

A clad article formed in accordance with the above-described process is characterized by improved workability and formability compared to an article formed of the same materials in accordance with prior known processing techniques. The clad article of the present invention, at least during hot and/or cold reduction or bending, includes a core of the densified metal powder and a metal cladding metallurgically bonded thereto. In a preferred embodiment, the metal powder core, from its interface with the metal cladding and throughout its volume, has a substantially uniform, low oxide volume fraction, preferably not greater than about 0.25 volume percent oxides. In a further embodiment the metal powder core can include a transition zone adjacent the core/cladding interface and extending a limited distance from the interface toward the center of the core wherein the average oxide volume fraction is not significantly greater than the average oxide volume fraction of the remainder of the core. Within the transition zone, the concentration of oxides is characterized by a gradual, declining gradient from the interface to the end of the transition zone. The depth of the transition zone can be different for different article forms and sizes and can vary from about 100–400 microns depending on the amount of cross-sectional reduction imposed on the article during working. The transition zone can be further divided into two or more subzones of substantially equal width. For a transition zone of 400 microns four subzones each 100 microns wide have been used for analyzing oxide concentrations with satisfactory results. A gradual, declining gradient of metal oxide concentration in the transition zone is defined as (a) an average oxide volume fraction that is not greater than about 0.25 volume percent where the average oxide volume fraction for each subzone of the transition zone is not more than about 0.25 volume percent or, (b) an average oxide volume fraction greater than about 0.25 volume percent in a subzone of the transition zone immediately adjacent the core/cladding interface, and not greater than about 1.4 times the average oxide volume fraction of the next adjacent subzone. The relevant width of a subzone is readily determined with reference to the magnification used in analyzing equipment in order to detect oxides of the smallest desired size. For example, to detect oxides of about 0.2 $\mu m^2$, a magnification of at least about 2000× is needed. A subzone of about 100 microns can be analyzed with good results using such magnification.

Either of the foregoing embodiments provide freedom from the embrittlement caused by the relatively higher concentrations of oxides hitherto present adjacent the core/cladding interface and the resulting impaired ductility, workability and formability of relatively large clad articles.

EXAMPLES

As an example of the process according to the present invention, clad articles in the form of slabs, Examples 1 and 2, were prepared. The chemical compositions of the core material for Examples 1 and 2 are shown in Table II. Analyses are given in weight percent unless otherwise specified.

TABLE II

| Ex. | C | Mn | Si | P | S | Cr | Ni | Mo | Cu | N | 0 (ppm) | B | Fe |
|---|---|---|---|---|---|---|---|---|---|---|---|---|---|
| 1 | .031 | 1.72 | .57 | .016 | .002 | 18.50 | 13.75 | .07 | .06 | .027 | 263 | 1.17 | Bal. |
| 2 | .029 | 1.73 | .57 | .016 | .002 | 18.60 | 13.70 | .06 | .06 | .023 | 276 | 1.18 | Bal. |
| A | .040 | 1.81 | .48 | .017 | .005 | 18.32 | 13.00 | .22 | .12 | .023 | 138 | 2.20 | Bal. |

Examples 1 and 2 were prepared from argon atomized, prealloyed powder that was screened to −40 mesh, blended, and then baked in air at an oven temperature of 250 F. Rectangular metal containers of AISI Type 304 stainless steel measuring 41-½ in×12 in×88 in with a wall thickness of ¼ in, were assembled for Examples 1 and 2 by welding together two elongated, U-shaped sidewalls and two end walls. Prior to assembly, one of the sidewalls was cleaned by wiping with reagent grade acetone. In order to reduce the cleaning time and labor, the remaining three pieces were steam cleaned and then wiped with the reagent grade acetone. The welding procedure included root welds made by the GTA welding process followed by fill welds made by the GMA welding process. After fabrication, the metal containers were baked at an oven temperature of 250 F.

The heated metal powder for Examples 1 and 2 loaded into the heated containers in ambient air. The powder for Example 1 was loaded from a temperature of 223 F. and the powder for Example 2 from a temperature of 214 F. The containers were filled at a fill rate of about 6200 lb/h. The temperature of the container exterior surface and the temperature of the metal powder were monitored while the containers were being filled. The filling of the containers for Examples 1 and 2 was stopped when, in each case, the temperature of the metal powder reached 170 F., at which time the temperature of the respective container was measured to be 140 F. The container of Example 1 contained 6150 lb of powder and the container of Example 2 contained about 5180 lb of powder when filling was interrupted. The partly filled containers and the remainder of the metal powder were reheated by baking at an oven temperature of 250 F. After reheating, the remainder of the metal powder was loaded into the containers. The powder for Example 1 was loaded from a reheat temperature of 243 F. and the powder for Example 2 from a reheat temperature of 237 F. The fill holes on the containers were then sealed by welding. About 7866 lb of powder was loaded into the container of Example 1 and about 7784 lb of powder was loaded into the Example 2 container. The powder-filled containers were consolidated by hot isostatic pressing at 2050 F. under a pressure of 15,000 psi for 5 h. The consolidated containers were than hot worked by hot rolling from 2125 F. to 35-½in×5 in×15 ft slabs, representing a reduction in cross-sectional area of 64.4% from the original container dimensions.

For comparison, an additional clad article, Example A, in the form of a slab also was prepared by a process similar to that of Examples 1 and 2 but with the following differences. The composition of the core material for Example A is shown in Table I. A cylindrical container, 14 in O.D.×85 in and having a wall thickness of ¼ in, was fabricated for Example A by welding end walls over the open ends of seam welded pipe. After welding one of the end walls in place, the interior surfaces of the container were cleaned by sand-blasting and then rinsed with industrial-grade acetone. The metal container for Example A was filled with 2457 lb of the blended powder at room temperature under a vacuum of less than 10 microns Hg and then sealed. Neither the blended metal powder nor the container were heated prior to or during the filling step. The powder filled container was hot isostatically pressed similarly to Examples 1 and 2. Example B was rotary forged from 2100 F. to 12 in×4 in×17 ft slab, representing a reduction in cross-sectional area of 68.8%.

Metallographic evaluation of Examples 1, 2, and A was carried out as follows. Samples for metallographic evaluation, ⅝ in×⅞ in, were cut from the top and bottom ends (A and X) of Examples 1 and 2 in the as-hot worked condition. A sample of Example A was cut from a disk previously cut from the center of the Example A slab. Each sample was analyzed over five 100 micron wide subzones. The samples were polished and then examined on a Leitz Model TAS Plus automatic image analyzer with an 80× objective lens and a screen magnification of 2620×. The results of the metallographic evaluation by image analysis of the samples are shown in Table III as the volume percent of metal oxides (Vol. %) in each range. The values given were determined by scanning 50 fields each of which was 7100 $\mu m^2$ in area. The data presented in Table III are the average Vol. % over the 50 fields scanned for each range.

TABLE III

| Dist. from Core/Cladding Interface (μm) | Vol. % | | |
|---|---|---|---|
| | Ex. 1A/1X | Ex. 2A/2X | Ex. A |
| 0–100 | 0.170/0.166 | 0.068/0.122 | 0.501 |
| 100–200 | 0.127/0.218 | 0.148/0.220 | 0.114 |
| 200–300 | 0.244/0.209 | 0.121/0.192 | 0.089 |
| 300–400 | 0.125/0.215 | 0.129/0.188 | 0.106 |
| >400 | 0.124/0.181 | 0.090/0.137 | 0.098 |

The data of Table III show the low, substantially uniform oxide volume fraction of Examples 1 and 2. It is significant to note the very steep oxide volume fraction gradient in the first 200 microns of the transition zone of Example A. That condition is indicative of the low ductility, workability, and/or formability of that article.

Figure 1B:
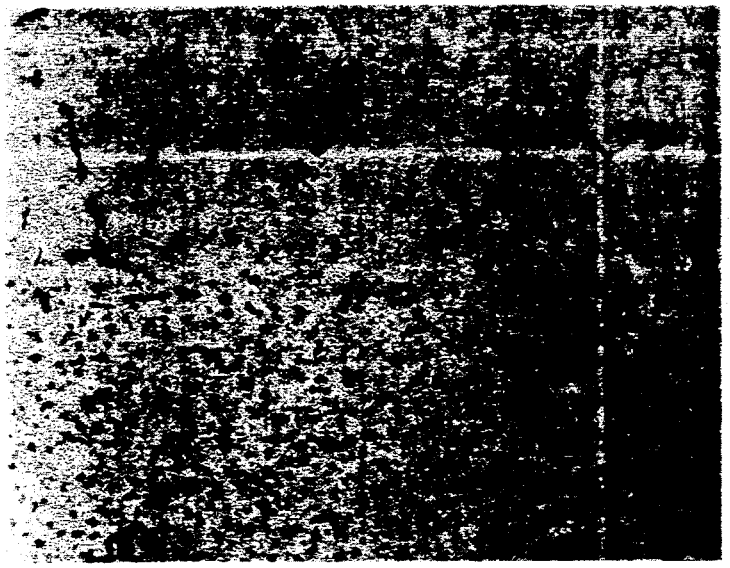
Figure 1C:
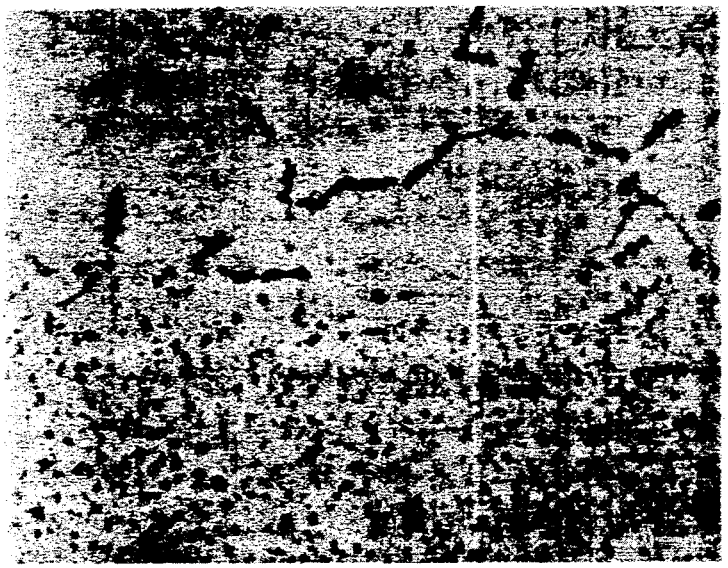
Figure 2A:
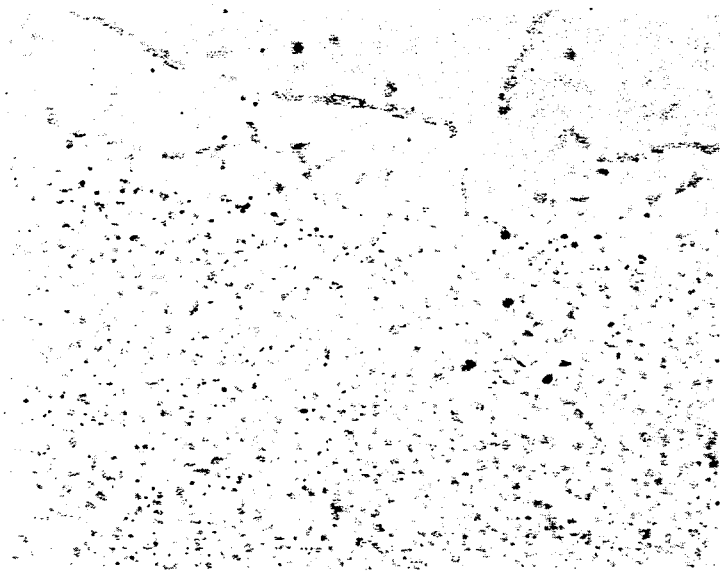
FIGS. 2A to 2D are photomicrographs at 400× showing transverse sections of the article of Example 2 herein also made by the process of the present invention.
Figure 2B:
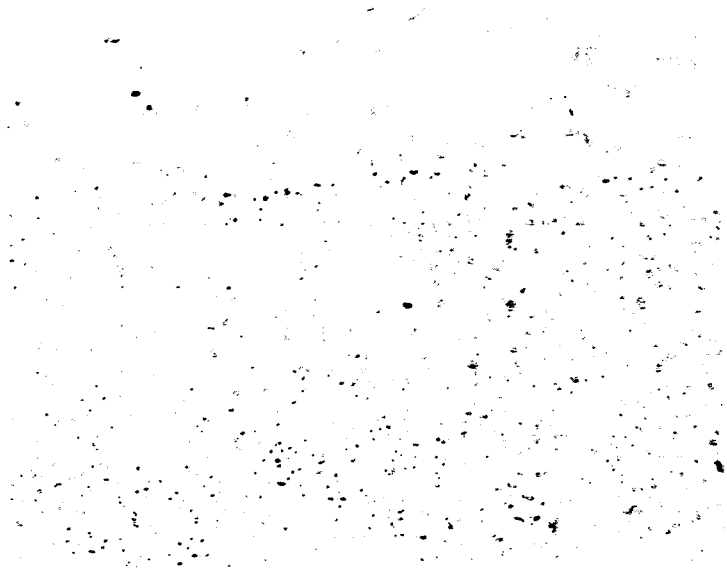
Figure 2C:
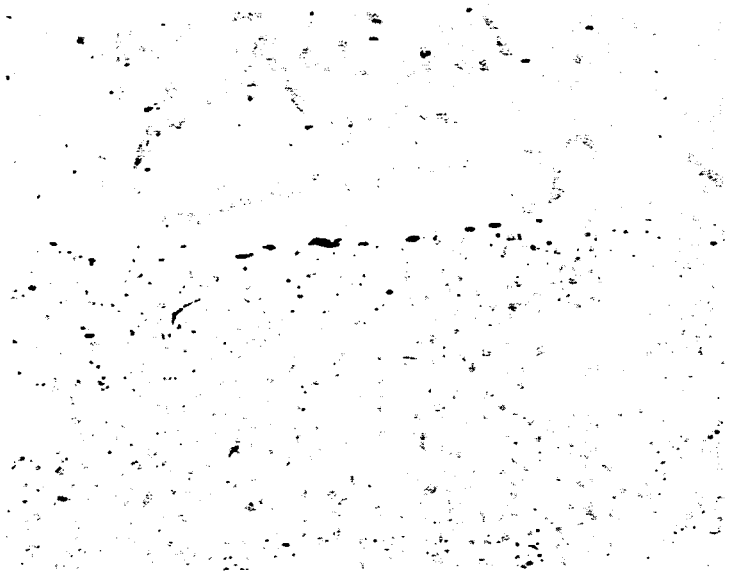
Figure 2D:
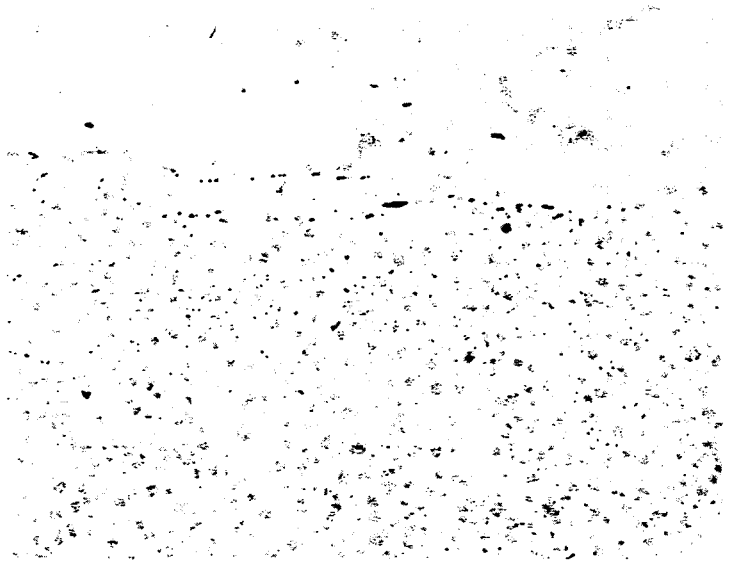
Figure 3A:
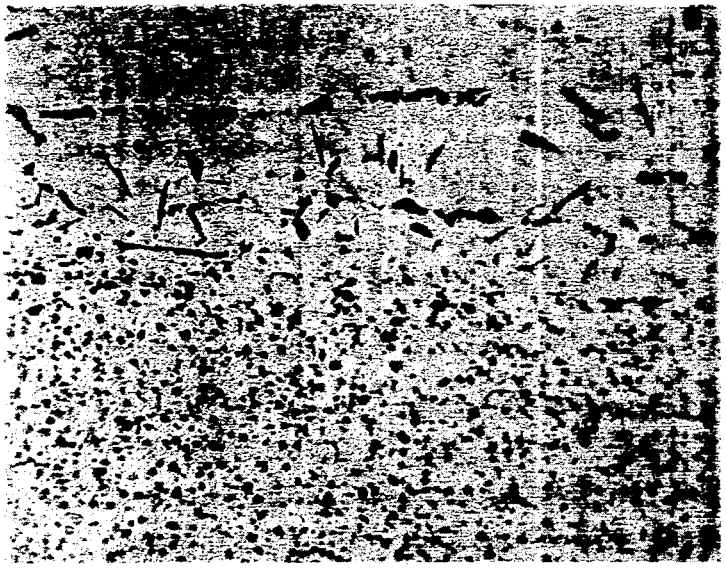
FIGS. 3A to 3D are photomicrographs at 400× showing transverse sections of the article of Example A herein made by a process not within the present invention.
Figure 3B:
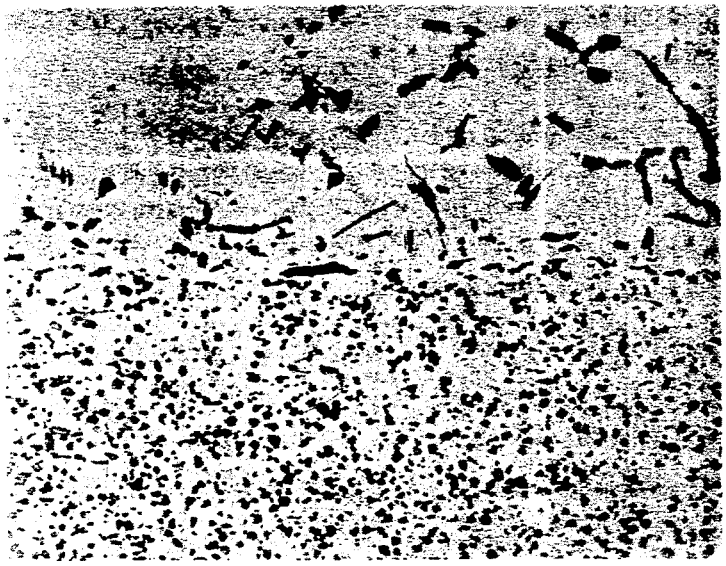
Figure 3C:
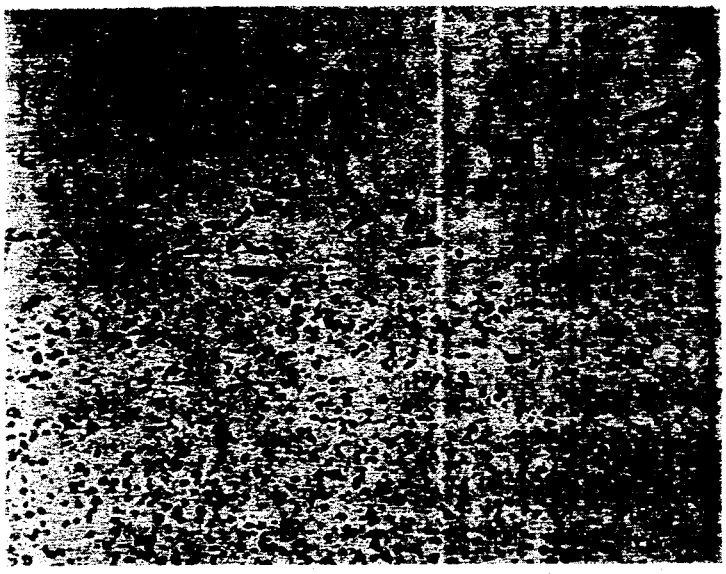
Figure 3D:
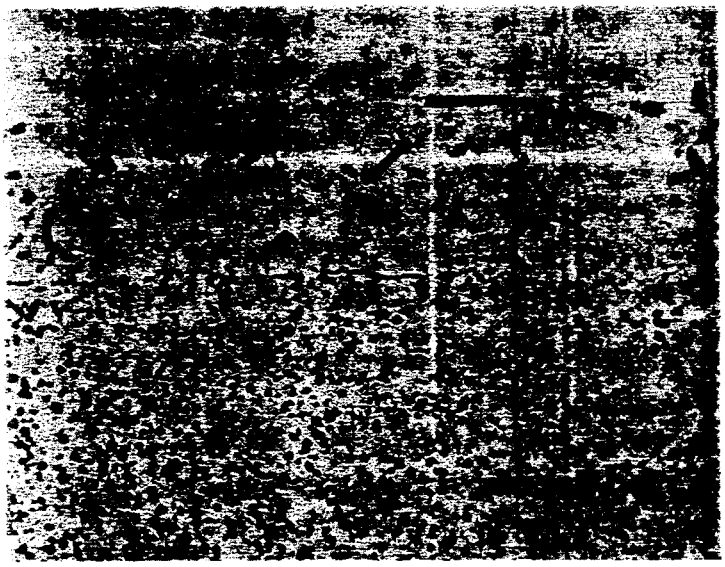

Referring now to the drawings, the photomicrographs were prepared from the specimens on which the image analysis was performed. Each figure shows a portion of the cladding, A, toward the top of the drawing, a portion of the core, B, toward the bottom of the drawing, and the core/cladding interface, C, in between them. Each photomicrograph depicts an area of the respective sample that is about 240 microns wide by 180 microns high. The metal oxides, which appear as black areas, are significantly sparser in FIGS. 1A–1C, and 2A–2D (Examples 1 and 2) compared to FIGS. 3A–3D (Example A) especially at the interface and for a short distance into the core.

Example A experienced partial delamination of the cladding from the core when it was hot worked after consolidation. Whereas Examples 1 and 2 showed no evidence of delamination and were subsequently hot rolled to 0.276 in plate without any delamination.

The terms and expressions which have been employed herein are used as terms of description and not of limitation. There is no intention in the use of such terms and expressions to exclude any equivalents of the features described or any portion thereof. It is recognized, however, that various modifications are possible within the scope of the invention claimed.

What is claimed is:

1. A process for making a shaped article having improved workability and formability, said article including a core formed of densified metal powder within a compatible metal cladding, said process comprising the steps of heating metal powder that is substantially free of oxides to a temperature within a first temperature range defined by a first lower temperature that is high enough to remove moisture from and prevent the adsorption of moisture by the metal powder and a first upper temperature that is low enough to prevent oxidation of the metal powder in air;

feeding the heated metal powder into a heated metal container having an interior surface that is substantially free of oxide contamination, said container being at a temperature within a second temperature range defined by a second lower temperature that is high enough to remove moisture from and prevent the adsorption of moisture by the interior surface and a second upper temperature that is low enough to prevent oxidation of the interior surface in air;

controlling the temperature of the metal powder such that it is maintained within the first temperature range during said feeding step;

sealing the metal container while it is within said second temperature range; and consolidating the sealed container so as to densify the metal powder and metallurgically bond the container to the densified metal powder across an interface therebetween so as to form the metal cladding;

whereby, following said consolidation step the core has a zone adjacent the interface wherein the average oxide volume fraction is not significantly greater than the average oxide volume fraction of the remainder of the core so as to provide local ductility in said core zone that is essentially equal to that of the remainder of the core.

2. A process as set forth in claim 1 wherein the temperature controlling step comprises the steps of measuring the temperature of the metal powder; and reheating the metal powder in said container to a temperature within the first temperature range when the measured temperature of the metal powder is near the first lower temperature.

3. A process as set forth in claim 2 wherein the controlling step further comprises reheating the unfilled metal powder to a temperature within the first temperature range when the measured temperature of the unfilled metal powder is near the first lower temperature.

4. A process as set forth in claim 2 wherein the temperature controlling step comprises the steps of measuring the temperature of the metal container; and reheating the metal container to a temperature within the second temperature range when the measured temperature of the metal container is near the second lower temperature.

5. A process as set forth in claim 1 wherein the temperature controlling step comprises the step of maintaining the metal container at a temperature within the second temperature range.

6. A process as set forth in claim 1 comprising the step of assembling the metal container so as to limit the formation of oxides on the interior surface of the container.

7. A process as set forth in claim 6 wherein the step of assembling the metal container comprises the further step of cleaning the interior surfaces of the sidewall and end wall with a reagent grade of solvent before the welding thereof.

8. A shaped, clad article having improved workability and formability comprising:

a core of densified metal powder; and a metal cladding metallurgically bonded to said core across an interface therebetween;

said core including a zone adjacent said interface having an average oxide volume fraction that is less than that which embrittles said zone so as to cause rupture between the cladding and the core along the interface during working or forming.

9. A clad article as set forth in claim 8 wherein the zone adjacent the interface has an average oxide volume fraction that is not significantly greater than the average oxide volume fraction of the remainder of the core so as to provide ductility in said zone that is essentially equal to that of the remainder of the core.

10. A clad article as set forth in claim 9 wherein the zone adjacent the interface is characterized by an average oxide volume fraction that is about equal to the average oxide volume fraction of the remainder of the core.

11. A clad article as set forth in claim 9 wherein said core, including the zone adjacent said interface, is characterized by a substantially uniform oxide volume fraction.

12. A clad article as set forth in claim 8 wherein said zone adjacent the interface extends from the interface to a depth of up to about 400 microns into the core.

13. A clad article as set forth in claim 12 wherein the zone adjacent the interface includes a first subzone immediately adjacent the interface and a second subzone next adjacent said first subzone, and the ratio of the average oxide volume fraction of the first subzone to the average oxide volume fraction of the second subzone is not more than about 1.4 when the average oxide volume fraction of the first subzone is greater than about 0.25%.

14. A clad article as set forth in claim 11 wherein the average oxide volume fraction of said core is not more than about 0.25%.

* * * * *